US008872072B2

(12) United States Patent
Yoshida et al.

(10) Patent No.: US 8,872,072 B2
(45) Date of Patent: Oct. 28, 2014

(54) HEAT-PRODUCING ELEMENT FOR FIXING DEVICE AND IMAGE FORMING APPARATUS

(75) Inventors: Eiichi Yoshida, Tokyo (JP); Akira Ohira, Tokyo (JP); Susumu Sudo, Tokyo (JP); Izumi Mukoyama, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 747 days.

(21) Appl. No.: 13/113,271

(22) Filed: May 23, 2011

(65) Prior Publication Data

US 2011/0293342 A1 Dec. 1, 2011

(30) Foreign Application Priority Data

May 28, 2010 (JP) ..... 2010-122661

(51) Int. Cl.

| | |
|---|---|
| ***H05B 1/00*** | (2006.01) |
| ***H05B 3/00*** | (2006.01) |
| ***H05B 11/00*** | (2006.01) |
| ***G03G 15/20*** | (2006.01) |

(52) U.S. Cl.
CPC ..... *G03G 15/2057* (2013.01)
USPC ..... 219/216; 252/511

(58) Field of Classification Search
USPC ..... 219/216, 534, 553, 528, 672, 544, 219/121.72, 121.64, 121.67; 399/333; 432/228, 60, 87, 23, 13, 9; 29/434, 29/889.7, 525.11, 889.22, 846, 623.9, 898, 29/745
See application file for complete search history.

(56) References Cited

U.S. PATENT DOCUMENTS

| | | | | |
|---|---|---|---|---|
| 3,697,450 | A * | 10/1972 | Takenaka et al. | 252/511 |
| 4,652,462 | A * | 3/1987 | Nishizawa et al. | 427/555 |
| 2002/0011475 | A1* | 1/2002 | Haneda et al. | 219/216 |
| 2003/0071245 | A1* | 4/2003 | Harris, IV | 252/500 |
| 2009/0230114 | A1* | 9/2009 | Taniguchi et al. | 219/216 |
| 2010/0273059 | A1* | 10/2010 | Sano | 429/231.7 |

FOREIGN PATENT DOCUMENTS

| | | |
|---|---|---|
| JP | 04-349387 | 12/1992 |
| JP | 06-340567 | 12/1994 |

(Continued)

OTHER PUBLICATIONS

Japanese Office Action, Notice of Rejection, Application No. P2010-122661, issue date: Aug. 16, 2013 (3 pages).

(Continued)

*Primary Examiner* — Henry Yuen
*Assistant Examiner* — Phuong Nguyen
(74) *Attorney, Agent, or Firm* — Lucas & Mercanti, LLP

(57) ABSTRACT

A heat-producing element for a fixing device to carry out heat-fixing after a toner image having been formed using a pulverized toner is transferred on an image support, a heat-producing element for a fixing device in which a thin-leaf graphite-pulverized material of a volume specific resistance of $10^{-6}$ Ω·cm to less than $10^{-2}$ Ω·cm is incorporated in a heat-resistant resin as a conductive material.

4 Claims, 3 Drawing Sheets

(56) References Cited

FOREIGN PATENT DOCUMENTS

| | | | | |
|---|---|---|---|---|
| JP | 07-296945 | | 11/1995 | |
| JP | 2000-048938 | | 2/2000 | |
| JP | 2000-077167 | | 3/2000 | |
| JP | 2000-090930 | | 3/2000 | |
| JP | 2004-281123 | | 10/2004 | |
| JP | 2006-350241 | | 12/2006 | |
| JP | 2007-272223 | | 10/2007 | |
| JP | 2007272223 | * | 10/2007 | ..... B29C 41/14 |
| JP | 2008138039 | * | 6/2008 | ..... C08K 3/04 |
| WO | 2007/026420 | | 3/2007 | |

OTHER PUBLICATIONS

English translation of Japanese Office Action, Notice of Rejection, Application No. P2010-122661, issue date: Aug. 16, 2013 (2 pages).
Japanese Office Action, Reasons of Rejection, Japan Patent Application No. P2010-122661, mail date: Jan. 21, 2014 (3 pages).
English translation of Japanese Office Action, Reasons of Rejection, Japan Patent Application No. P2010-122661, mail date: Jan. 21, 2014 (3 pages).

* cited by examiner

HEAT-PRODUCING ELEMENT FOR FIXING DEVICE AND IMAGE FORMING APPARATUS

This application is based on Japanese Patent Application No. 2010-422661 filed on May 28, 2010, in Japanese Patent Office, the entire content of which is hereby incorporated by reference.

TECHNICAL FIELD

The present invention relates to a heat-producing element for a fixing device and an image forming apparatus using the same.

BACKGROUND

Conventionally, in image forming apparatuses such as copiers and laser beam printers, a method, in which after toner development, an unfixed toner image having been transferred on an image support such as plain paper is subjected to contact heating fixing using a heat roller system, has been used in many cases.

However, in such a heat roller system, it takes long time to achieve the fixable temperature by healing and also a large amount of heating energy is required. From the viewpoint of shortening of the time from power activation to copy start (the warming-up time) and energy saving, recently, a heat film fixing system has become mainstream.

In a fixing device (fixing unit) of this heat film fixing system, a seamless fixing belt, in which a releasable layer such as a fluorine resin is laminated on the outer surface of a heat-resistant film such as polyimide, is used.

Incidentally, in a fixing device of such a heat film fixing system, since a film is heated, for example, via a ceramic heater and then a toner image is fixed on the film surface, the thermal conductivity of the film becomes a critical point. However, when the fixing belt film is allowed to be thinner to improve the thermal conductivity, mechanical strength tends to decrease and then it becomes difficult to realize high-speed rotation, whereby formation of a high quality image at high speed becomes problematic and also such a problem that the ceramic heater is liable to break is produced.

To solve such problems, recently, a method has been proposed in which a fixing belt itself is provided with a heat-producing body and then the heat-producing body is fed, whereby the fixing belt is directly heated to fix a toner image. In an image forming apparatus of this system, warming-up time is shortened and power consumption is further reduced. Therefore, as a heat fixing device, excellence is expressed from the viewpoint of energy saving and speeding up.

Such a technology includes the following: for example, (1) a heat-producing body constituted of a conductive material such as conductive ceramic, conductive carbon, or metal powder and an insulating material such as insulating ceramic or a heat-resistant resin (Parent Document 1), (2) a heat-producing element having a heat-producing layer in which a carbon nanomaterial and filament-shaped metal fine panicles are dispersed in a polyimide resin, as well as having an insulating layer and a releasing layer (Patent Document 2), and (3) a technology in which a fixing device employs a heat-producing element featuring positive temperature characteristics; and a heat-producing layer is formed of a conductive oxide and can also be formed by mixing the oxide and a resin (Patent Document 3).

PRIOR ART DOCUMENTS

Patent Documents

Patent Document 1: Unexamined Japanese Patent Application Publication (hereinafter referred to as JP-A) No. 2004-281123

Patent Document 2: JP-A No. 2007-272223

Patent Document 3: JP-A No. 2006-350241

BRIEF DESCRIPTION OF THE INVENTION

Problems to be Solved by the Invention

The technological development of a fixing device employing a heat-producing element is being actively conducted as described above. However, a metallic filler such as copper, nickel, or silver enabling to efficiently realize resistance reduction of the heat-producing element produces some sort of a problem such as resistance increase via oxidation, safety, and high cost, whereby adequate performance as a heat-producing element cannot be maintained for a long term.

The present invention was completed to solve the above problems.

Namely, an object of the present invention is to provide a heat-producing fixing belt in which the resistance of a heat-producing element can be efficiently reduced, high performance can be maintained for a long term, and energy saving can be realized due to reduced warming-up time and excellent thermal efficiency, and an image forming apparatus using the same.

Means to Solve the Problems

The inventors of the present invention focused on a resistance reduction effect in the case of use of graphite which is inexpensive and stable as a substance and then investigated the possibility of practical use thereof. Artificial graphite, in which amorphous carbon is graphitized, is fired in the graphitization step at a temperature of several thousand degrees and thereby extremely stable at a temperature range of 100 to 200° C. which is employed for a fixing belt. Further, since graphite contains nothing but carbon, no problem is noted either from the safety point of view, and no cost problem is produced either. However, the problem that the resistance thereof is not reduced as mush as a metallic filler has remained.

However, it was found that when a thin-leaf graphite-pulverized material satisfying specific requirements is used, resistance reduction was realized equivalently to a metallic filler. The reason is presumed to reduce resistance since conductive paths are formed densely with no discontinuity compared with the conventional conductive material. The present invention was completed via further repeated investigations based on these findings.

Namely, it was found that an object of the present invention was able to be achieved employing the following constitution:

(1) In a heat-producing element for a fixing device to carry out heat-fixing after a toner image having been formed using a toner is transferred on an image support, a heat-producing element for a fixing device in which a thin-leaf graphite-pulverized material of a volume specific resistance of not less than $10^{-6}$ Ω·cm to less than $10^{-2}$ Ω·cm is incorporated in a heat-resistant resin as a conductive material.

(2) The heat-producing element for a fixing device, described in item (1), in which the heat-resistant resin comprises a polyimide resin as a main component.

(3) The heat-producing element for a fixing device, described in item (1) or (2), in which in the thin-leaf graphite-pulverized material, the thickness is 0.05 μm to 1.0 μm, the average volume particle diameter is 5.0 μm to 50 μm, and the ratio ($D_{10}/D_{90}$) of the particle diameter ($D_{10}$) of a volume fraction of 10% to the particle diameter ($D_{90}$) of a volume fraction of 90% is 0.10 to 0.30.

(4) The heat-producing element for a fixing device, described in any of items (1) to (3), in which, the thin-leaf graphite-pulverized material is mixed with a carbon fiber at 5.0% by mass to 50% by mass.

(5) The heat-producing element for a fixing device, described in any of items (1) to (3), in which the thin-leaf graphite-pulverized material is mixed with a carbon nanofiber at 5.0% by mass to 50% by mass.

(6) In an image forming apparatus in which after uniform charging of an electrophotographic photoreceptor, a toner image having been formed using an image exposure member and a toner developing member is transferred on an image support and then fixed using a heat fixing member, an image forming apparatus using the heat-producing element for a fixing device described in any of items (1) to (5) as the heat fixing member.

The present invention makes it possible to provide a heat-producing fixing belt in which the resistance of a heat-producing element can be efficiently reduced, high performance can be maintained for a long term, and energy saving can be realized due to reduced warming-up time and excellent thermal efficiency; and an image forming apparatus using the same.

PREFERRED EMBODIMENTS OF THE INVENTION

The present invention, materials to be used, and an image forming apparatus will now further be described.

The heat-producing element of the present invention may have any shape such as a belt shape and a pipe shape according to the use methods in an image forming apparatus.

In the conventional fixing device, a heat-producing element for a fixing device in which a carbon nanomaterial or filament-shaped metal fine particles are dispersed in a polyimide resin and a heat-producing element containing a conductive oxide have been proposed. However, to coordinate the heat-producing layer of a heat-producing element for the targeted electrical resistivity, a large amount of a compound is added, whereby the problems that the strength of the heat-producing layer is decreased and durability is degraded have been produced.

The feature of the present invention is that a thin leaf graphite-pulverized material, which has an electrical specific resistance close to that of metal as a conductive material, is hard to oxide compared with copper, and is more inexpensive than silver and gold, resulting in use in a wide range of applications, is used as a conductive material to constitute a heat-producing layer, and thereby a heat-producing element satisfying the targeted electrical resistance and temperature-rising characteristics and exhibiting enhanced durability has been provided.

The present invention has realized a heat-producing element exhibiting small resistance and uniformity basically using one type of conductive material featuring small resistance. However, usage by mixing a carbon nanofiber or a carbon fiber at 5.0% by mass to 50% by mass is employable, and these embodiments can be considered to be preferred examples of the present invention.

[Configuration of the Heat-Producing Element for a Fixing Device of the Present Invention]

Figure 1:
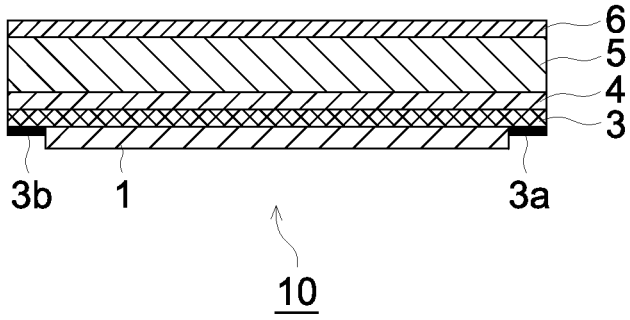
FIG. 1 is a constitutional sectional view showing the constitution of a typical heat-producing element of the present invention.

FIG. 1 is a constitutional sectional view showing the configuration of a typical heat-producing element of the present invention.

In a heat-producing element 10, the support 1 is formed of a heat-resistant resin such as polyimide and a thin metal plate such as stainless steel, iron, or aluminum. Thereon, a heat-producing layer 3, whose end portions are provided with power supplying terminals 3*a* and 3*b* is coated and then via an adhering resin layer 4, an elastic body layer 5 and further a releasing layer 6 serving as the surface layer are provided. However, this represents a typical layer configuration. In the present invention, with regard to the layer constitution, any constitution may be employed as long as the constitution realizes a heat-producing element having a heat-producing layer 3 in which a thin leaf graphite-pulverized material is incorporated in a heat-resistant resin as a conductive material. A thickness of the heat-producing element as a whole is preferably 200 to 600 μm. A thickness of the heat-producing layer is preferably 50 to 200 μm. A thickness of the elastic body layer is preferably 100 to 300 μm. A thickness of the releasing layer is preferably 5 to 30 μm. A thickness of the insulating resin layer is preferably 5 to 30 μm.

With regard to the production method therefor, a common method is also employable.

Figure 2:
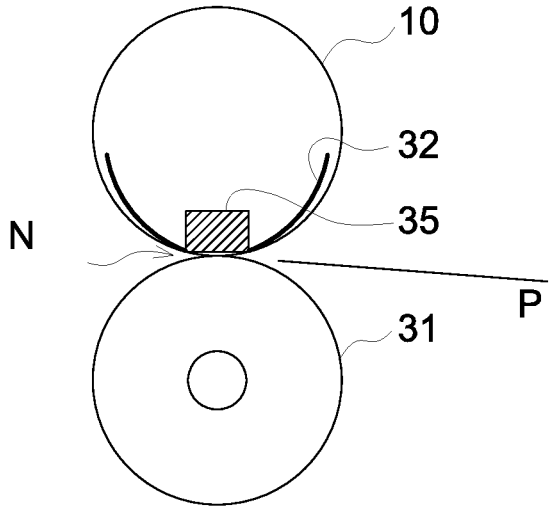
FIG. 2 is a constitutional schematic view of a fixing device incorporating a heat-producing element of the present invention.

Next, FIG. 2 shows a constitutional schematic view of a fixing device incorporating a heat-producing element of the present invention. The heat-producing element 10 is pressed against an opposed pressure roller 31 by a pressure member 35. N represents the nip portion produced by the heat-producing element 10 having been pressed by the pressure member 35 and the pressure roller 31. The symbol 32 represents the guide member of the heat-producing element 10.

An image support P on which an unfixed toner image has been placed is passed through this nip portion and conveyed, whereby the toner image is fixed on the image support P.

[Thin-Leaf Graphite-Pulverized Material]

Graphite is one of the allotropes of carbon referred to also as plumbago or graphite, being a crystal body in which carbon atoms having a network surface structure hexagonally arranged are assembled in layers.

A black opaque hexagonal plate crystal having metallic luster is typical, but of those naturally produced, there are some in which coal denatured in the crust and then the degree of carbonization proceeded. In the present invention, the former is preferable, a large amount of which is produced industrially using amorphous carbon as a raw material. This material exhibits excellent electrical conductivity, high melting point, and chemical stability.

In the present invention, graphite is pulverized to produce to have thin-leaf shape graphite used as a conductive material, being, however, referred to as a thin leaf graphite-pulverized material with no specific description of "thin-leaf" in cases in which no problem is produced. In pulverization into a thin leaf graphite-pulverized material, pulverization is preferably carried out using either of a jet mill method and a ball mill method. Pulverization under inert gas ambience is specifically preferable. The thin-leaf graphite can be obtained from the market.

The volume specific resistance of such a thin leaf graphite-pulverized material is $10^{-6}$ Ω·cm to less than $10^{--2}$ Ω·cm. When the volume specific resistance is less than $10^{-6}$ Ω·cm, resistance is excessively decreased, whereby expected heat-producing performance cannot be realized. The resistance of a heat-producing element to which a material having a volume specific resistance of not less than $10^{-2}$Ω·cm has been added is not reduced, resulting in inadequate heat-production. The volume specific resistance is preferably not less than $10^{-6}$ Ω·cm to less than $10^{-5}$ Ω·cm.

Figure 4:
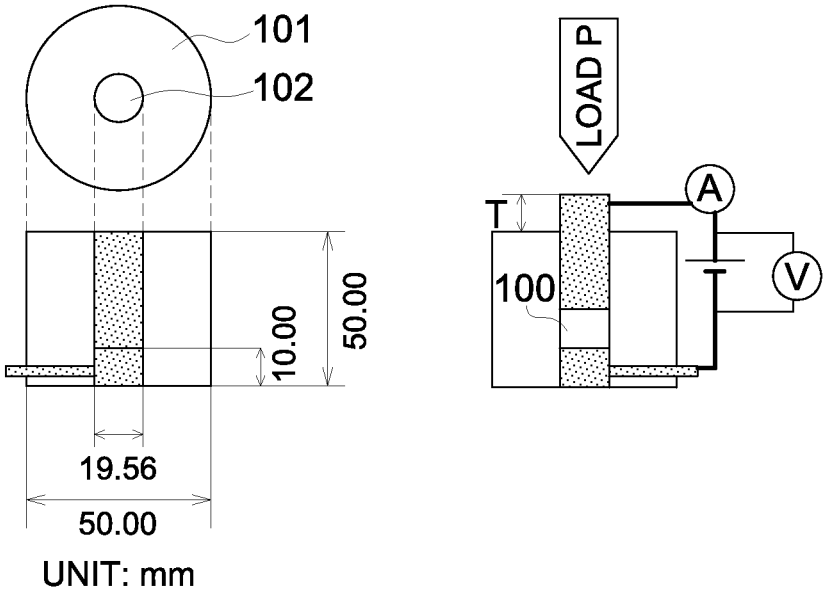
FIG. 4 is a constitutional illustrative view of a measurement device of volume specific resistance.

Volume specific resistance (Ω·cm) is represented by RAIL (R: electrical resistance (Ω), L: conductor length (m), and A: conductor cross-sectional area ($m^2$)). For the determination thereof the device of FIG. 4 is used. One gram of a thin leaf graphite-pulverized material 100 is placed in a ring-shaped TEFLON (a registered trademark) container 101, followed by being placed on a table vibrator in the pressureless state to be vibrated for 10 minutes. Thereafter, a stainless steel rod 102 having somewhat a smaller diameter than the ring inner diameter of the ring-shaped TEFLON (a registered trademark) container 101 is applied with a load of 2940 N (300 kgw) and in this state, the value of a current which flows by applying a voltage (10 V) is measured to determine volume specific resistance.

In FIG. 4, numbers represent lengths (mm).

The volume specific resistance varies with the properties based on the production method for graphite, the ambience in the pulverization step, and the particle shape via the pulverization method. Therefore, selection of these raw materials and pulverization step conditions are allowed to change, whereby the volume specific resistance value is controlled to obtain a thin leaf graphite-pulverized material falling in the scope employable in the present invention.

With regard to the particle shape after pulverization, if other conditions are the same, the volume specific resistance of a spherically shaped material becomes larger and that of a largely non-uniform material becomes smaller. The thin-leaf graphite material has a thickness of 0.05 μm to 1.0 μm, and preferably 0.05 μm to 0.5 μm.

The average volume particle diameter of a thin leaf graphite-pulverized material is preferably in the range of 5.0 to 50 μm, and more preferably 5.0 μm to 25 μm. Those exhibiting uniform particle diameter distribution are preferable. As the situation is observed at intervals and particle diameter is measured during pulverization, pulverization is carried out, whereby those having this range can be obtained with relative ease.

Those having an average volume particle diameter of more than 50 μm tend to produce a non-uniform heat-producing state in the heat-producing element, whereby fixing offset may occur.

In the case of an average volume particle diameter of less than 5.0 μm, conduction paths are hard to form and resistivity is hard to reduce in some cases.

With regard to the determination method of average volume particle diameter ($D_{50}$), a device, in which "MULTISIZER 3 (produced by Beckman Coulter, Inc.)" is connected to a computer system mounted with data processing software "Software V 3.51" (produced by Beckman Coulter, Inc.), is used for measurement and calculation.

As to the determination procedure, 0.02 g of graphite is wetted with 20 ml of a surfactant solution (a surfactant solution in which, for example, a neutral detergent containing a surfactant component is diluted with pure water by a factor of 10 to disperse graphite), followed by ultrasonic dispersion for 1 minute to produce a graphite dispersion liquid. This graphite dispersion liquid is injected with a pipette into a beaker containing ISOTONII ((produced by Beckman Coulter, Inc.) in the sample stand until the measurement device display concentration reaches 5% to 10%. When this concentration range is achieved, reproducible determination values are obtained. In the measurement device, the measurement particle count number is set at 25000, the aperture diameter is set at 100 μm, and a rage of 1 to 30 μm which is the determination range is divided into 256 to calculate a frequency value. The particle diameter at the 50% point from the larger volume integral fraction side is designated as the volume based median diameter ($D_{50}$).

Further, the particle diameter at the 10% point from the smaller volume integral fraction side is defined as $D_{10}$ and the particle diameter at the 90% point therefrom is defined as $D_{90}$. Then, those having a relatively uniform particle diameter, in which the ratio ($D_{10}/D_{90}$) of the both is 0.10 to 0.30, are preferable.

[Heat-Resistant Resins]

In general, those having a short-term heat resistance of at least 200° C. and a long-term heat resistance of at least 150° C. are referred to as heat-resistant resins. Such typical heat-resistant resins are listed as described below.

These are polyphenylene sulfide (PPS), polyarylate (PAR), polysulfone (PSF), polyethersulfone (PES), polyetherimide (PEI), polyimide (PA), and polyetheretherketone (PEEK) resins.

Of these, in the present invention, a specifically preferable heat-resistant resin is a polyimide resin.

Any of these is mixed with a thin leaf graphite-pulverized material and used as a low resistance heat-producing layer, as well as being used as a constituent resin of other layers.

In the present invention, the phrase "as a main component" refers to the case where the above resin accounts for at least 50% by mass of the entire resin amount.

Heat is produced by supplying electric power, through, for example terminals provided at the end portion of the heat producing element. Power is controlled in accordance with the resistance of the heat producing element, applied voltage, fixing line speed and so on.

[Image Forming Apparatus]

For the image forming apparatus of the present invention, a commonly structured one is employable except the fixing device.

A typical apparatus will now be described.

In FIG. 3, 1Y, 1M, 1C, and 1K represent photoreceptors and 4Y, 4M, 4C, and 4K represent developing devices; 5Y, 5M, 5C, and 5K represent primary transfer rollers as primary transfer members and 5A represents a secondary transfer roller as a secondary transfer member; and 6Y, 6M, 6C, and 6K represent cleaning devices. And then, 7, 24, and 70 represent an intermediate transfer body unit, a heat roller-system fixing device, and an intermediate transfer body, respectively.

This image forming apparatus is referred to as a tandem-type image forming apparatus, which is provided with plural sets of image forming sections 10Y, 10M, 10C, and 10K, an endless belt-shaped intermediate transfer body unit 7 serving as a transfer section, an endless belt-shaped sheet feed/conveyance member 21 to convey an image support P, and a heat-producing element-system fixing device serving as a fixing member. On top of the main body A of the image forming apparatus, an original image reading apparatus SC is arranged.

The image forming section 10Y to form a yellow image as one of the toner images of different color formed on each photoreceptor has a drum-shaped photoreceptor 1Y as a first photoreceptor, as well as a charging member 2Y, an exposure member 3Y, a developing member 4Y, a primary transfer roller 5Y as a primary transfer member, and a cleaning member 6Y arranged in the periphery of the photoreceptor drum 1Y. Further, the image forming section 10M to form a magenta image as another one of the toner images of different color has a drum-shaped photoreceptor 1M as a first photoreceptor, as well as a charging member 2M, an exposure member 3M, a developing member 4M, a primary transfer roller 5M as a primary transfer member, and a cleaning member 6M arranged in the periphery of the photoreceptor drum 1M.

Still further, the image forming section 10C to form a cyan image as another one of the toner images of different color has a drum-shaped photoreceptor 1C as a first photoreceptor, as well as a charging member 2C, an exposure member 3C, a developing member 4C, a primary transfer roller 5C as a primary transfer member, and a cleaning member 6C arranged in the periphery of the photoreceptor drum 1C. Furthermore, the image forming section 10K to form a black image as another one of the toner images of different color has a drum-shaped photoreceptor 1K as a first photoreceptor, as well as a charging member 2K, an exposure member 3K, a developing member 4K, a primary transfer roller 5K as a primary transfer member, and a cleaning member 6K arranged in the periphery of the photoreceptor drum 1K.

The endless belt-shaped intermediate transfer body unit 7 has an endless belt-shaped intermediate transfer body 70 as a second image carrier of an intermediate transfer endless belt shape which is wound around a plurality of rollers and rotatably supported.

Each of the color images having been formed by the image forming sections 10Y, 10M, 10C, and 10K is successively transferred onto the rotating endless belt-shaped intermediate transfer body 70 by the primary transfer rollers 5Y, 5M, 5C, and 5K to form a composed color image. An image support P such as a sheet as a transfer medium accommodated in a sheet feed cassette 20 is fed by the sheet feed/conveyance member 21, and passed through a plurality of intermediate rollers 22A, 228, 22C, and 22D, and a registration roller 23, followed by being conveyed to a secondary transfer roller 5A serving as a secondary transfer member to collectively transfer the color images onto the image support P. The image support P, on which the color images have been transferred, is subjected to fixing treatment using the heat-producing element-system fixing device 24, and then is nipped by a sheet discharging roller 25 and placed onto a sheet discharging tray 26 outside the apparatus.

On the other hand, the color image is transferred onto the image support P by the secondary transfer roller 5A, and thereafter the residual toner on the endless belt-shaped intermediate transfer body 70, which has curvature-separated the image support P, is removed by the cleaning member 6A.

During image forming processing, the primary transfer roller 5K is always in pressure contact with the photoreceptor 1K. The other primary transfer rollers 5Y, 5M, and 5C each are brought into pressure contact with the corresponding photoreceptors 1Y, 1M, and 1C only during color image formation.

The secondary transfer roller 5A is brought into pressure contact with the endless belt-shaped intermediate transfer body 70 only when an image support P is passed at this roller position for the secondary transfer.

In this manner, toner images are formed on the photoreceptors 1Y, 1M, 1C, and 1K via charging, exposure, and development and then each of the color toner images is superimposed on the endless belt-shaped intermediate transfer body 70, followed by collective transfer thereof onto an image support P to carry out pressure and heating fixation by the fixing device 24 for fixing. With regard to the photoreceptors 1Y, 1M, 1C, and 1K from which the toner images have been transferred on the image support P, the toners having been allowed to remain on the photoreceptors during transfer are cleaned by the cleaning device 6A and thereafter, the photoreceptors enter the above cycle of charging, exposure, and development for the following image formation.

For an image forming apparatus employing a toner according to the present invention as a non-magnetic single component developer, the above two component developing device needs only to be replaced with a non-magnetic single component developing device.

Further, as the photoreceptor, any appropriate inorganic photoreceptor or organic photoreceptor is usable.

Figure 3:
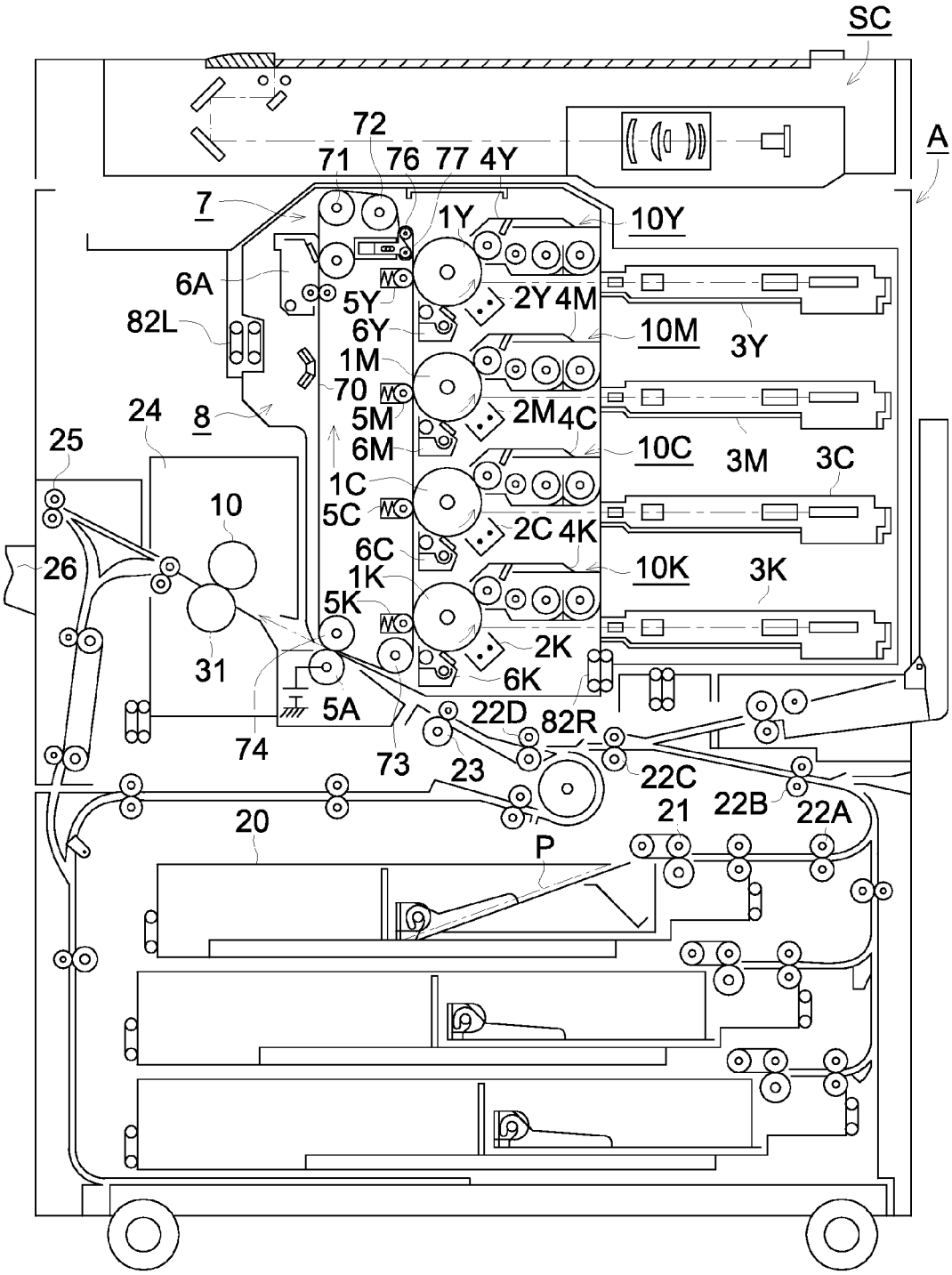
FIG. 3 is a sectional constitutional view showing one example of an image forming apparatus of the present invention.

In FIG. 3, a fixing device 24 of the heat-producing element fixing system incorporating a heat-producing element of the present invention and a pressure roller is used.

[Image Supports]

An image support (referred to also as a recording medium, recording paper, or a recording sheet) enabling to form an image using a toner according to the present invention may be a commonly used one, which needs only to be one holding a toner image having been formed via an image forming method employing, for example, the above image forming apparatus. As those used as usable image supports in the present invention, there are listed, for example, plain paper, being thin to thick, bond paper, art paper, and coated printing paper such as coated paper, as well as commercially available Japanese paper and postcard paper, OHP plastic films, and cloths.

EXAMPLES

A typical embodiment of the present invention and effects thereof will now be described to further describe the present invention.

[Preparation of Thin-Leaf Graphite-Pulverized Materials]

With respect to thin leaf graphite-pulverized materials, artificial graphite manufactured by Nippon Graphite Industries, Co., Ltd. having been previously pulverized coarsely was pulverized using a ball mill for 1 to 100 hours by changing ambiences such as ones in nitrogen gas and the atmosphere. Then, also particle shape was controlled and volume specific resistance was adjusted. The graphite materials used except for Comparative Example 2 were prepared in nitrogen gas, and Comparative Example 2 was prepared in the atmosphere.

[Preparation of Heat-Producing Layer Dopes]

There were sufficiently mixed 100 g of polyamic acid (U-varnish S301, produced by Ube Industries, Ltd.) and 18 g of each of various types of graphite fine powder described in Examples 1 to 8 and Comparative Examples 1 to 3 of Table 1 using a planetary stirring machine.

TABLE 1

| | Conductive Material | Volume Specific Resistance (Ω · cm) | Thickness (μm) | Average Volume Particle Diameter (μm) | $D_{10}/D_{90}$ |
|---|---|---|---|---|---|
| Example 1 | graphite | $10^{-5}$ | 0.07 | 40 | 0.15 |
| Example 2 | graphite | $10^{-3}$ | 0.07 | 15 | 0.15 |
| Example 3 | graphite | $10^{-4}$ | 0.055 | 25 | 0.15 |
| Example 4 | graphite | $10^{-4.5}$ | 0.99 | 25 | 0.15 |
| Example 5 | graphite | $10^{-3.5}$ | 0.07 | 6 | 0.15 |
| Example 6 | graphite | $10^{-4.5}$ | 0.07 | 48 | 0.15 |
| Example 7 | graphite | $10^{-3.5}$ | 0.07 | 25 | 0.11 |
| Example 8 | graphite | $10^{-4.5}$ | 0.07 | 25 | 0.29 |
| Example 9 | graphite | $10^{-2.5}$ | 0.045 | 25 | 0.15 |
| Example 10 | graphite | $10^{-5.5}$ | 1.05 | 25 | 0.15 |
| Example 11 | graphite | $10^{-2.5}$ | 0.07 | 4 | 0.15 |
| Example 12 | graphite | $10^{-5}$ | 0.07 | 55 | 0.15 |
| Example 13 | graphite | $10^{-2.5}$ | 0.07 | 25 | 0.05 |
| Example 14 | graphite | $10^{-4.5}$ | 0.07 | 25 | 0.35 |
| Comparative Example 1 | graphite | $10^{-7}$ | 0.005 | 90 | 0.15 |
| Comparative Example 2 | graphite | $10^{-1}$ | 0.07 | 25 | 0.15 |
| Comparative Example 3 | nickel | $10^{-6}$ | 0.50 | 20 | 0.20 |

[Production of Heat-Producing Elements]

(Pipe Support)

The heat producing elements have pipe shape in the Example, and the shape may be modified as desired.

A stainless steel pipe of an outer diameter of 30 mm and a total length of 345 mm having been previously coated with a releasing agent was coated with polyamic acid (U-varnish 5301, produced by Ube Industries, Ltd.) at a film thickness of 500 μm. Thereafter, drying was carried out at 150° C. for 3 hours, and pipe support having a dry thickness of around 70 μm was formed (Production of a Heat-Producing Layer)

On the reinforcing layer, a dope was coated at a film thickness of 500 μm. Then, drying was carried out at 150° C. for 3 hours, followed by 30-minute drying at 400° C. for imidization. Heat-Producing Layer having a dry thickness of around 100 μm was formed.

(Production of an Elastic Body Layer)

The polyimide resin pipe-shaped material fitted for the stainless pipe was brush-coated with a primer (trade name: "X331565," produced by Shin-Etsu Chemical Co., Ltd.), followed by drying at normal temperature for 30 minutes.

Thereafter, a mixture of a liquid rubber of silicone rubber "KE1379" (a trade name, produced by Shin-Etsu Chemical Co., Ltd.) and silicone rubber "DY356013" (a trade name, produced by Dow Corning Toray Co., Ltd.) at ratio of 2:1 was coated on the outer surface of a polyimide pipe-shaped material at a thickness of 200 μm as silicone rubber.

Then, primary vulcanization was carried out at 150° C. for 30 minutes and further, post vulcanization was carried out at 200° C. for 4 hours to obtain a pipe-shaped material in which silicone rubber of a thickness of 200 μm was formed on the outer layer of a polyimide pipe-shaped material. The hardness of the rubber layer was 26 degrees.

(Production of a Releasing Layer)

The silicone rubber surface was cleaned, and then using a PTFE resin dispersion (trade name: "30J," produced by E. I. du Pont de Nemours and Company) as a fluorine resin (B), the silicone rubber was immersed for 3 minutes while being rotated therein and then taken out, followed by drying at normal temperature for 20 minutes. Then, the fluorine resin on the silicone rubber surface was wiped off with a cloth.

Thereafter, in a fluorine resin dispersion (trade name: "855-510," produced by E. I. du Pont de Nemours and Company) in which as a fluorine resin (A), a PTFE resin and a PFA resin had been mixed at a ratio of 7:3 for adjustment to a solid concentration of 45% and a viscosity of 0.110 Pa·s, a polyimide·silicone rubber-formed pipe-shaped material was immersed to carry out coating at a final thickness of 15 μm. After 30-minute drying at room temperature, heating was carried out at 230° C. for about 30 minutes. Then, passing was done over about 10 minutes through the interior of a pipe-shaped furnace of an inner diameter of 100 mm in which the inner furnace temperature had been set at 270° C. to fire the fluorine resin having been coated on the silicone rubber surface. Subsequently, after cooling, the pipe-shaped material was removed from the die. Power supplying terminals were provided at the ends of the obtained pipe via an electroless nickel plating. Thus the targeted heat-producing element was obtained.

[Performance Evaluation]

(Initial Heat-Production)

A heat-producing element having each heat-producing layer shown in Examples 1 to 14 and Comparative Examples 1 to 3 of Table 1 was mounted in a fixing device having the constitution shown in FIG. 2, and then the heat-producing layer was applied with 100 V and driven at a linear velocity of 210 mm/sec to measure the time having elapsed until reaching to 180° C. from the initiation of energization. In cases in which no reaching to 180° C. was realized, the temperature after 10 seconds from the energization initiation was measured.

(Durability)

The heat-producing element was built into the image forming apparatus shown in FIG. 3 and then 500,000 sheets of an A4 image support were passed with 5-minute intermittence per 10,000 sheets. Thereafter, evaluation was conducted in the same manner as for the initial heat-production.

TABLE 2

| | 180° C. Reaching Time (sec) or Temperature after 10-second Energization. (° C.) | |
|---|---|---|
| | Initial Heat-Production | Heat-Production after Durability |
| Example 1 | 5 sec | 5 sec |
| Example 2 | 6 sec | 7 sec |
| Example 3 | 6 sec | 8 sec |
| Example 4 | 6 sec | 7 sec |
| Example 5 | 6 sec | 8 sec |
| Example 6 | 6 sec | 7 sec |
| Example 7 | 6 sec | 8 sec |
| Example 8 | 7 sec | 7 sec |
| Example 9 | 7 sec | 8 sec |
| Example 10 | 8 sec | 10 sec |
| Example 11 | 8 sec | 8 sec |
| Example 12 | 9 sec | 9 sec |
| Example 13 | 9 sec | 9 sec |
| Example 14 | 7 sec | 8 sec |
| Comparative Example 1 | 4 sec | 150° C. |
| Comparative Example 2 | 100° C. | 100° C. |
| Comparative Example 3 | 4 sec | 100° C. |

The evaluation results shown in Table 2 clearly show that every performance of Examples 1 to 14 is excellent but Comparative Examples 1 to 3 out of the present invention are problematic with respect to at least any one of the characteristics.

The invention claimed is:

1. A heat-producing fixing belt for fixing a toner image on an image support, comprising:

a support and having sequentially thereon, a heat-producing layer with a power supplying terminal, an adhering resin layer, an elastic body layer, and a releasing layer, wherein the heat-producing layer comprises a heat-resistant resin and a conductive material, the heat-resistant resin comprises a polyimide resin as a main component, wherein the conductive material is thin-leaf graphite having a volume specific resistance of not less than $10^{-6}$ Ω·cm to less than $10^{-2}$ Ω·cm, wherein the thin-leaf graphite material has a thickness of 0.05 μm to 1.0 μm, an average volume particle diameter of 5.0 μm to 50 μm, and a ratio ($D_{10}/D_{90}$) of the particle diameter ($D_{10}$) of a volume fraction of 10% to the particle diameter ($D_{90}$) of a volume fraction of 90% of 0.10 to 0.30, and wherein the heat-producing fixing belt comprises a carbon fiber or a carbon nanofiber 5.0% by mass to 50% by mass based on a weight of the thin-leaf graphite material.

2. The heat-producing fixing belt of claim 1, wherein the thin-leaf graphite has a volume specific resistance of not less than $10^{-6}$ Ω·cm to less than $10^{-5}$ Ω·cm.

3. The heat-producing fixing belt of claim 1, wherein the thin-leaf graphite material has a thickness of 0.05 μm to 0.5 μm, an average volume particle diameter of 5.0 μm to 25 μm.

4. A toner image forming apparatus comprising an electrophotographic photoreceptor for forming a static latent images a developing device developing the latent image to form a toner image on the photoreceptor, a transfer device transferring the toner image to an image support and a fixing device fixing the toner image on the image support, wherein the fixing device comprising a fixing belt, wherein the fixing belt comprises a support and having sequentially thereon, a heating-producing layer with a power supplying terminal, an adhering resin layer, an elastic body layer, and a releasing layer, wherein the heating-producing layer comprises a heat-resistant resin and a conductive material, the heat-resistant resin comprises a polyimide resin as a main component, wherein the conductive material is thin-leaf graphite having a volume specific resistance of not less than $10^{-6}$ Ω·cm, to less than $10^{-2}$ Ω·cm, wherein the thin-leaf graphite material has a thickness of 0.05 μm to 1.0 μm, an average volume particle diameter of 5.0 μm to 50 μm and a ratio $D_{10}/D_{90}$ of the article diameter $D_{10}$ of a volume fraction of 10% to the particle diameter $D_{90}$ of the volume fraction 90% of 0.10 to 0.30, and wherein the heat-producing fixing belt comprises a carbon fiber of a carbon nanofiber at 5.0% by mass to 50% by mass based on weight of the thin-leaf graphite material.

* * * * *